US006134726A

United States Patent [19]

Lau

[11] Patent Number: 6,134,726

[45] Date of Patent: Oct. 24, 2000

[54] ADULT-SIZE BED RETROFITTING SYSTEMS

[76] Inventor: Doris Man-yee Lau, 1219 Dell Dr., Monterey Park, Calif. 91754

[21] Appl. No.: 09/241,958

[22] Filed: Feb. 2, 1999

[51] Int. Cl.[7] ..... A47C 7/03

[52] U.S. Cl. ..... 5/93.1; 5/95

[58] Field of Search ..... 5/2.1, 93.1, 93.2, 5/97, 95, 512, 513; 160/127

[56] References Cited

U.S. PATENT DOCUMENTS

| | | | |
|---|---|---|---|
| 329,261 | 10/1985 | Bowles . | |
| 1,563,428 | 12/1925 | Melton . | |
| 2,412,005 | 12/1946 | Parsons . | |
| 2,471,977 | 5/1949 | Power . | |
| 2,646,576 | 7/1953 | Abrams | 5/95 |
| 2,676,337 | 4/1954 | Soeder . | |
| 4,525,883 | 7/1985 | Necowitz . | |
| 4,765,006 | 8/1988 | Jackson et al. . | |
| 4,890,346 | 1/1990 | Rist . | |
| 5,350,341 | 9/1994 | Wolscht . | |
| 5,430,899 | 7/1995 | Chisholm | 5/95 |
| 5,604,941 | 2/1997 | Roman . | |
| 5,715,551 | 2/1998 | Proano et al. . | |

FOREIGN PATENT DOCUMENTS

| | | |
|---|---|---|
| 581231- A1 | 7/1993 | European Pat. Off. . |

*Primary Examiner*—Terry Lee Melius
*Assistant Examiner*—Fredrick Conley
*Attorney, Agent, or Firm*—Ying-kit Lau

[57] ABSTRACT

A retrofitting system designed to convert an adult-size bed into an infant/toddler bed is disclosed. The retrofitting system comprises first a template is being placed on a twin, full, queen, king-or larger size bed with an underside of the template fitted to an underside of a mattress. The system further comprises a number of interconnecting geometrical shape structures connected to the template on the bed. A plate/channel system is used to connect the geometrical shape structures to the template. The template and geometrical shape structures can be disassembled and assembled for storage, cabinet, diaper change table, chair, table etc., as the child grows up. The system can further be converted into children's toys, such as a car, slide, activity center, snake etc. with accessories.

12 Claims, 5 Drawing Sheets

FIG. 1
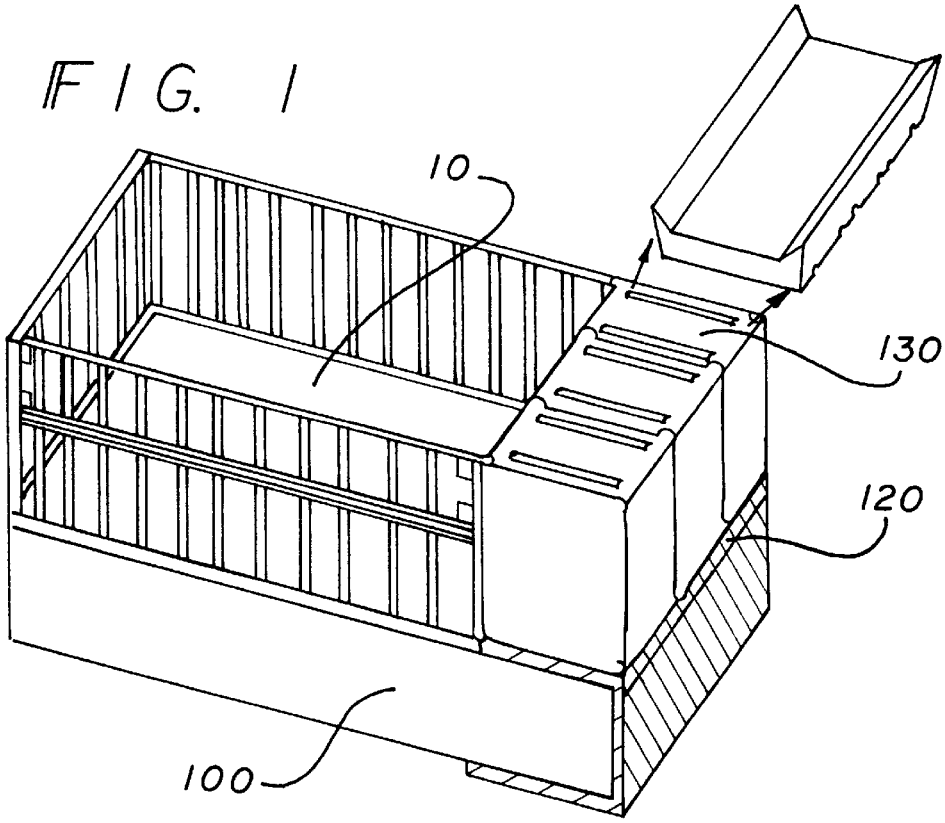
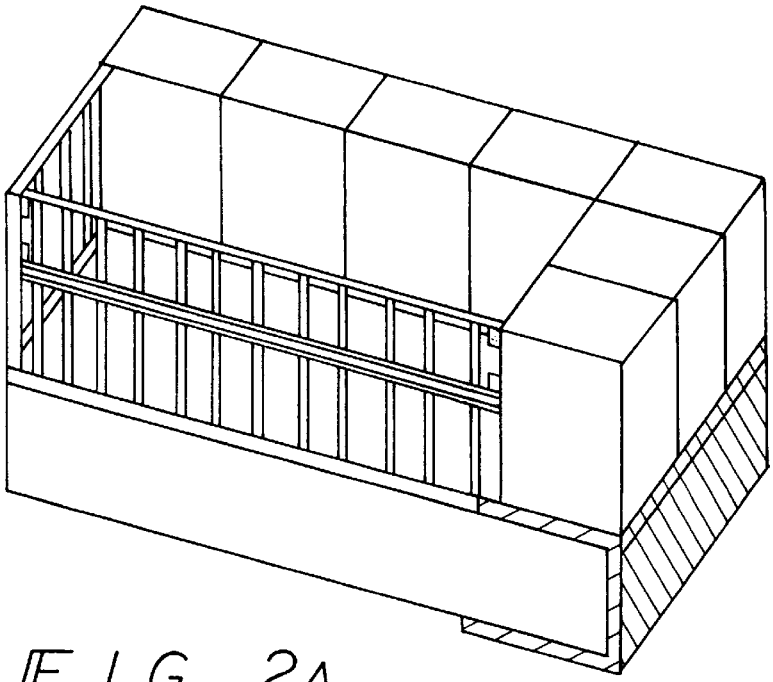
FIG. 2A

FIG. 4
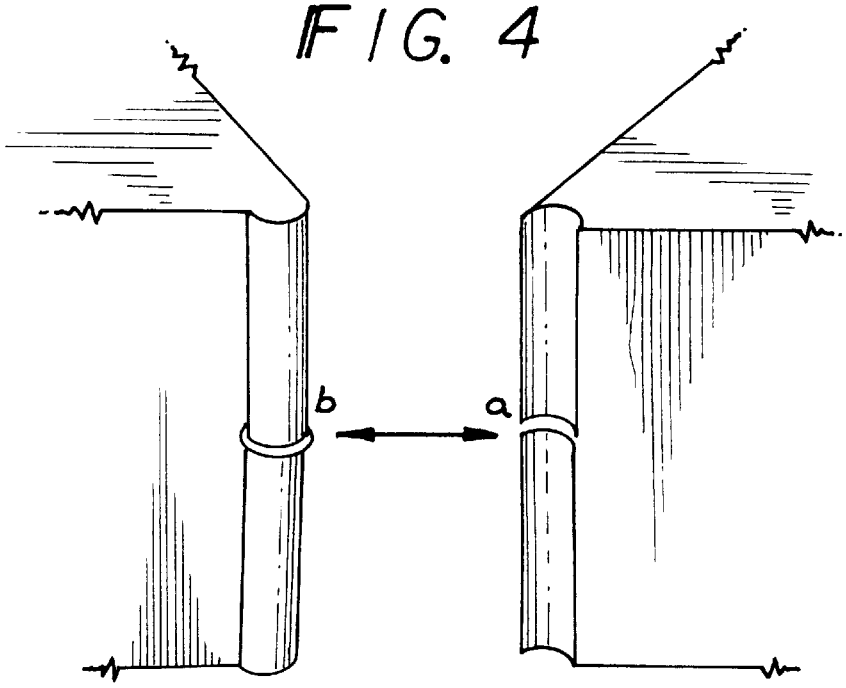
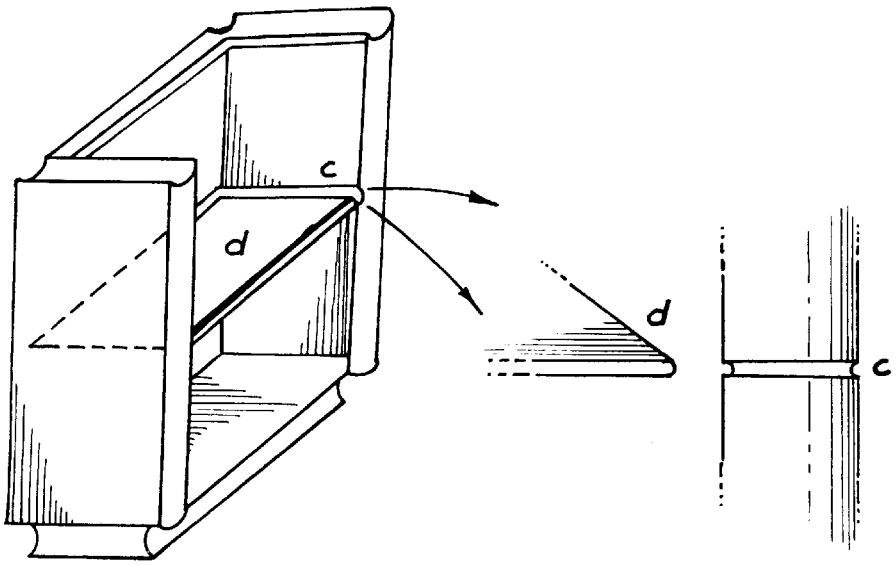
FIG. 5

FIG. 6
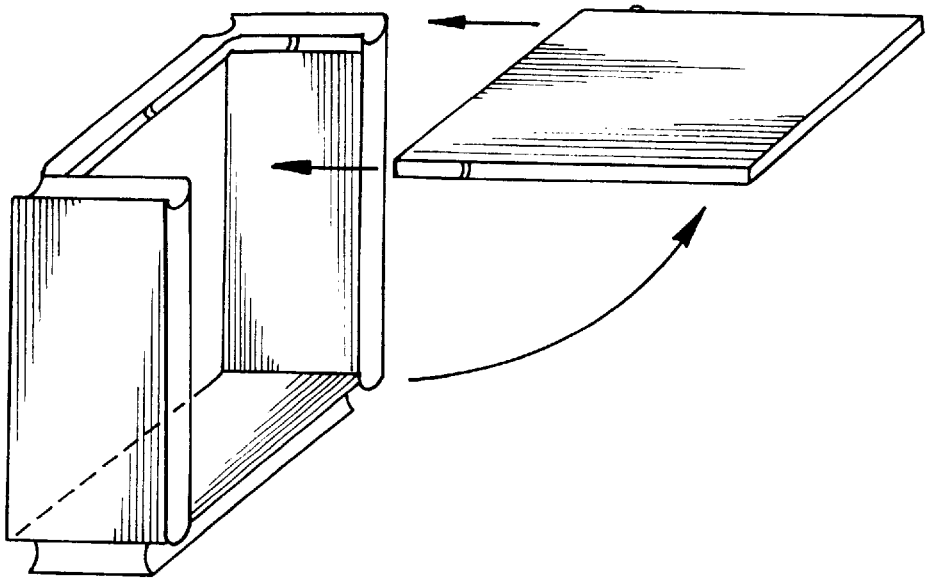
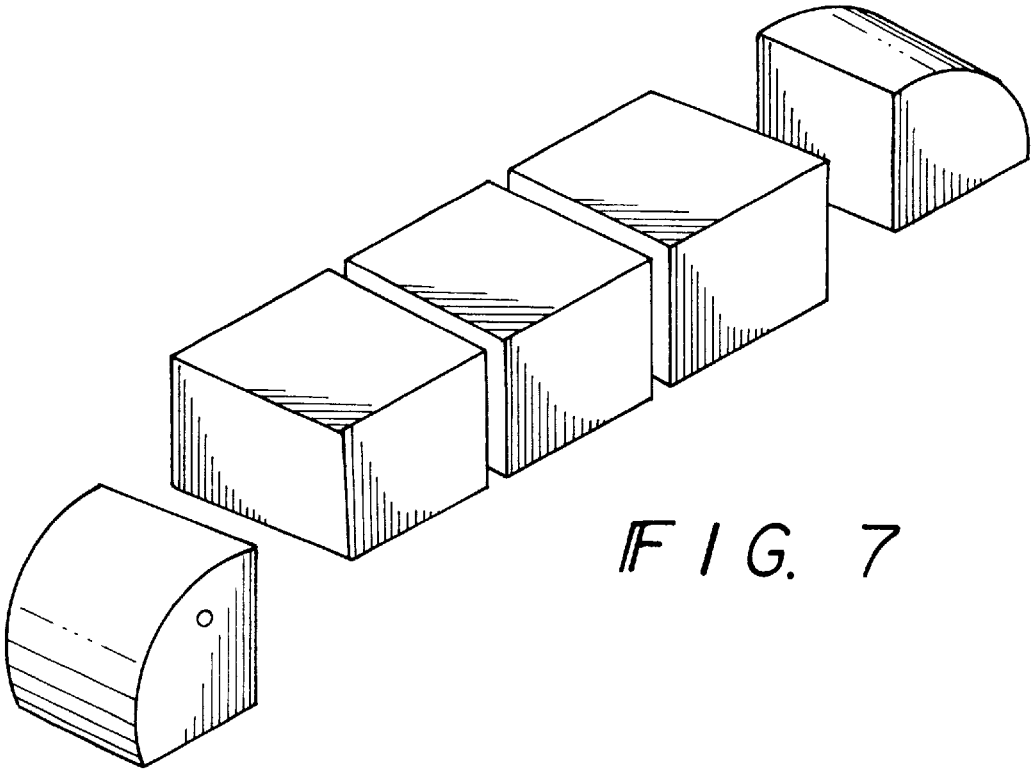
FIG. 7

ADULT-SIZE BED RETROFITTING SYSTEMS

BACKGROUND OF THE INVENTION

1. Field of the Invention

The present invention relates to a system designed to convert an adult-size bed into an infant/toddler bed. More specifically, the present invention is directed to converting a twin, full, queen, king or larger size bed into an infant/toddler bed. The system contains by first placing a template on a twin or larger-size adult bed with the underside of the template connected to the underside of a mattress of the bed. The system further contains a number of interconnecting geometrical shape structures connected to the template. The template and geometrical structures can be disassembled and assembled to form storage cabinet, diaper change table, chair, table, etc., as the child grows up. The geometrical structures can further be converted into children's toys, such as a car, slide, activity center, snake etc. with accessories provided.

2. Description of the Prior Art

There have been numerous designs for infant/toddler beds, children furniture, storage boxes and toys. However, as the infant/toddler grows up, most of these children items have to be disposed of because they cannot be converted into something useful. There have been systems, such as the "bed for life" which converts a crib into a twin-size bed by using two of the four bed-pieces. However, two sets of mattress are needed for this conversion. Furthermore, the bed-pieces cannot be converted into storage furniture or other useful items, such as toys.

Earlier patent to Parsons (U.S. Pat. No. 2,412,005) illustrates a combined bed and crib arrangement, in which a typical sized adult bed portion can be fitted (possibly retrofitted) with a removable crib portion, the crib portion being generally placed on the adult bed portion.

European Patent No. 581,231 A1 shows what appears to be a furniture assembly which can be removably placed on an existing bed structure for converting the bed structure for infant or toddler use. The assembly includes, among other structures, shelving and cabinet.

Wakefield's patent (U.S. Pat. No. 2,266,681), discloses a removable portable infant crib which can be placed on a conventionally sized bed.

The patent to Necowitz (U.S. Pat. No. 4,525,883), discloses a full size bed which can be converted to an infant's crib by raising a hidden vertical rail system.

The patent to Proano et al (U.S. Pat. No. 5,715,551), discloses convertible furniture which can be converted from an adult bed to an infant bed, and vice versa.

The patents to Soeder (U.S. Pat. No. 2,676,337) and Roman (U.S. Pat. No. 5,604,941), both disclose infant or toddler beds suited for removable placement on seats or sofas.

Melton's patent (U.S. Pat. No. 1,563,428), discloses an adult bed fitted with a slidable, hidden child's bed.

The patents to Power (U.S. Pat. No. 2,471,977) and Rist (U.S. Pat. No. 4,890,346), both disclose bed or crib partition devices that allow a bed or crib to be divided into two smaller beds.

The patent to Wolscht (U.S. Pat. No. 5,350,341), discloses an infant play enclosure equipped with several geometrical shapes.

None of the Patents discussed above discloses or teaches the invention of a re-useable retrofitting adult-size bed system in converting an adult-size bed into an infant/toddler bed using one set of mattress. Moreover, none of the patents discloses or teaches an adult-size bed retrofitting system that can be converted into other furniture, toys or other useful items. Thus, it would be desirable to provide a safe, convenient, economical, versatile, user and environmental-friendly retrofitting system for converting an adult size bed into an infant/toddler bed.

Accordingly, it is an object of the present invention to provide an adult size bed retrofitting system of the type set forth.

It is another object of the present invention to provide storage spaces, such as for baby clothing, diapers, lotion, towels, baby powder, baby wipe etc. handy near or at the bed for a mom or a caretaker's use with the baby.

It is another object of the present invention to provide versatile and useful devices, such as chair, table, changing table etc., which is converted from or assembled on the retrofitting bed-system.

Another object of the present invention is to provide useful and versatile devices, such as activity centers, toys, such as snake, children's car, slide etc. with accessories, such as wheels, head and tail of a snake etc. from the retrofitting system to reduce cost and space occupied by a bed and such centers and/or toys.

Other objects and advantage of the invention will become apparent from the following detailed disclosure.

SUMMARY OF THE INVENTION

In accordance with the present invention, an adult size bed retrofitting system is provided to eliminate the need for two sets of mattresses to convert an adult size bed into an infant/toddler bed. The system contains by first placing a template on an adult-sized bed, an underside of the template is fitted under the underside side of a mattress of the bed. A number of interconnecting geometrical shape structures is then connected to the template. The template and the geometrical structures can be disassembled and/or assembled and converted into storage cabinet, activity center, chair or table later as the child grow up. The interconnecting geometrical structures can further be converted into a toy, such as a car, slide, snake, easel, playground, activity gym, puzzle board, etc. with accessories.

The template is to be constructed of a safe, non-toxic and easy to fabricate material, such as thermoplastics, specialty plastics, thermosets, engineering plastics etc.

Thermoplastics include but not limited to: polyamideimide (PAI), polyethersulfone (PES), polyarylsulfone (PAS), polyetherimide (PEI), polyarylate (PAR), polysulfone (PSO), polyamide (PA), polycarbonate (PC), styrene-maleic anhydride (SMA), chorinated PVC (CPVC), poly (methylmethacrylate) (PMMA), styrene-acrylonitrile (SAN), polystyrene (PS), acrylonitrile-butadiene-styrene (PS), acrylonitrilebutadiene-styrene (ABS), poly (ethyleneterephthalate) (PET), poly(vinylchloride) (PVC), polyetherketone (PEK), polyetheretherketone (PEEK), polytetrafluoroethylene (PTFE), poly(phenylene sulfide) (PPS), liquid crystal polymer (CCP), nylon-6,6, nylon-6, nylon-6,12, nylon-11, nylon 12, acetal resin, low and high density polypropylene (PP), high density polyethylene (HDPE), low density polyethylene (LDPE), polystyrene, ethylene-vinyl acetate, poly-vinyl-acetate, polyacrylic, etc., or a copolymer or a combination thereof.

Specialty plastics include but not limited to fluorocarbon polymers and infusible film products such as Kapton, Upilex polyimide film etc., a coplymer or a combination thereof. Thermosets include but not limited to phenolics, epoxies, urea-formaldehyde, silicones, etc., a copolymer or a combination thereof. Engineering plastics include but not limited to acetyl resins, polyamide, polyetherimides, polyesters, liquid crystal polymers, polycarbonate resins, poly (phenylene ether) alloys, polysulfone resins, polyamideimide resins, etc., a copolymer or a combination thereof. An extension from the underside of the template is connected to the mattress (underside) of the bed. The template is then connected to a number of interconnecting geometrical shapes structures. The connection can be done by methods known to one skill in the art, such as a plate/channel connecting system. This template is vital in keeping the interconnecting geometrical shape structures stable and free from toppling-over by anyone pulling or leaning onto the structure. The geometrical shape structures can be of any shape, including but not limited to: the form of a row of triangular surfaces with a rectangular back surface; a row of rectangular surfaces with a rectangular back surface; a row of hexagonal surfaces with a hexagonal back surface etc.. The geometrical shape structures is also constructed of a safe, non-toxic and easy to fabricate material, such as but not limited to thermoplastics, specialty plastics, thermosets, engineering plastics etc.

Thermoplastics include but not limited to: polyamideimide (PAI), polyethersulfone (PES), polyarylsulfone (PAS), polyetherimide (PEI), polyarylate (PAR), polysulfone (PSO), polyamide (PA), polycarbonate (PC), styrene-maleic anhydride (SMA), chorinated PVC (CPVC), poly (methylmethacrylate) (PMMA), styrene-acrylonitrile (SAN), polystyrene (PS), acrylonitrile-butadiene-styrene (PS), acrylonitrilebutadiene-styrene (ABS), poly (ethyleneterephthalate) (PET), poly(vinylchloride) (PVC), polyetherketone (PEK), polyetheretherketone (PEEK), polytetrafluoroethylene (PTFE), poly(phenylene sulfide) (PPS), liquid crystal polymer (CCP), nylon-6,6, nylon-6, nylon-6,12, nylon-11, nylon 12, acetal resin, polypropylene (PP), high density polyethylene (HDPE), low density polyethylene (LDPE), polystyrene, ethylene-vinyl acetate, polyvinyl-acetate, polyacrylic, etc., or a copolymer or a combination thereof.

Specialty plastics include but not limited to fluorocarbon polymers, infusible film products such as Kapton and Upilex polyimide film, etc., a copolymer or a combination thereof. Thermosets include but not limited to phenolics, epoxies, urea-formaldehyde and silicones, etc., a copolymer or a combination thereof. Engineering plastics include but not limited to acetyl resins, polyamide, polyetherimides, polyesters, liquid crystal polymers, polycarbonate resins, poly(phenylene ether) alloys, polysulfone resins, polyamideimide resins, etc., a copolymer or a combination thereof. These structures are interconnected by methods familiar to one skill in the art. The preferred embodiment includes but not limited to having a geometrical shape structure with at least two surfaces . One surface comprises of a male connecting plates and the other a channel. This way the plate of one structure is connected to the channel of another structure forming the interconnecting geometrical shape structures.

BRIEF DESCRIPTION OF THE DRAWING

The novel features which are believed to be characteristic of the invention are set forth with particularity in the appended claims. The invention itself, however, both as to its organization and method of construction and operation, may best be understood by reference to the following description, taken in connection with the accompanying drawing in which:

FIG. 1 is a perspective side view of a retrofitting system on one side of an adult-size bed;

FIG. 2A is a perspective side view of a retrofitting system on two sides of an adult-size bed;

FIG. 4 is a perspective side-view of a close-up of the plate/channel connecting system;

FIG. 5 is a geometrical shape structure in the form of a converted chair;

FIG. 6 is a geometrical shape structure in the form of a converted table; and FIG. 7 shows the retrofitting system with accessories to form a snake.

DESCRIPTION OF THE PREFERRED EMBODIMENT

Figure 2B:
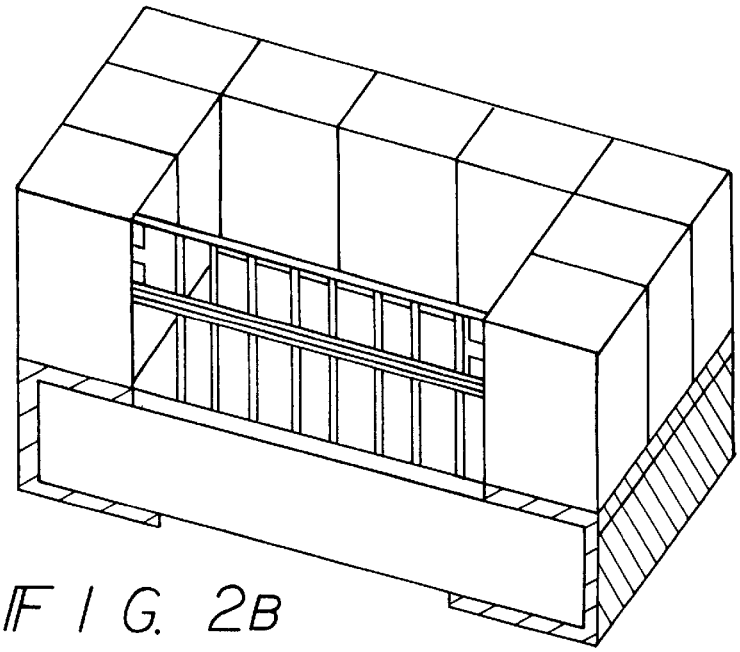
FIG. 2B is a perspective side view of a retrofitting system on three sides of an adult-size bed.
Figure 3:
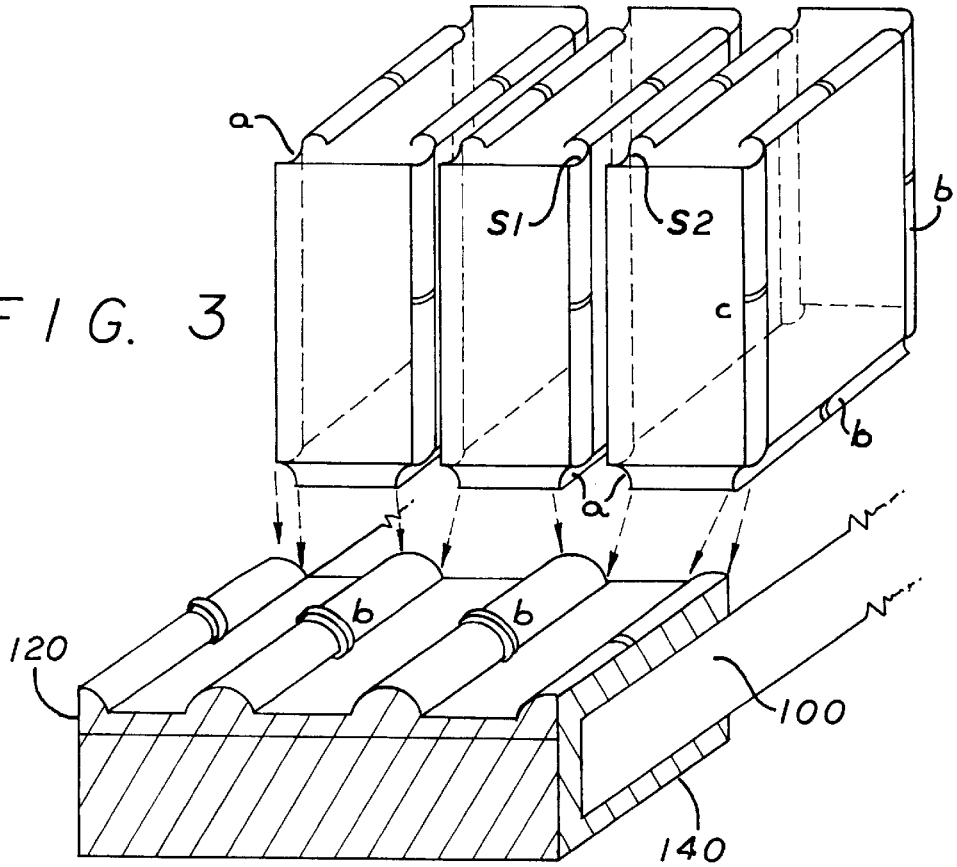
FIG. 3 is a side view of a rectangular shaped retrofitting system showing the plate and channel connecting system and part of the template for the retrofitting system.
Figure 3A:
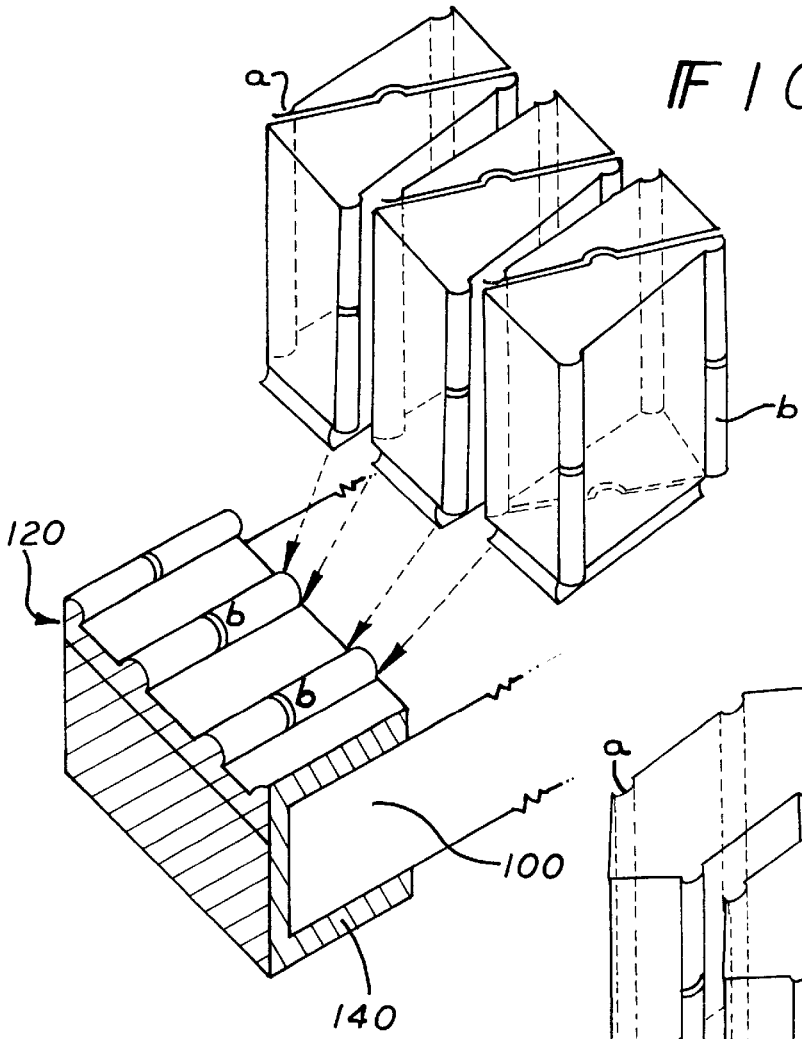
FIG. 3A is a perspective side views of a row of triangular surfaces with a rectangular back surface of a retrofitting system.
Figure 3B:
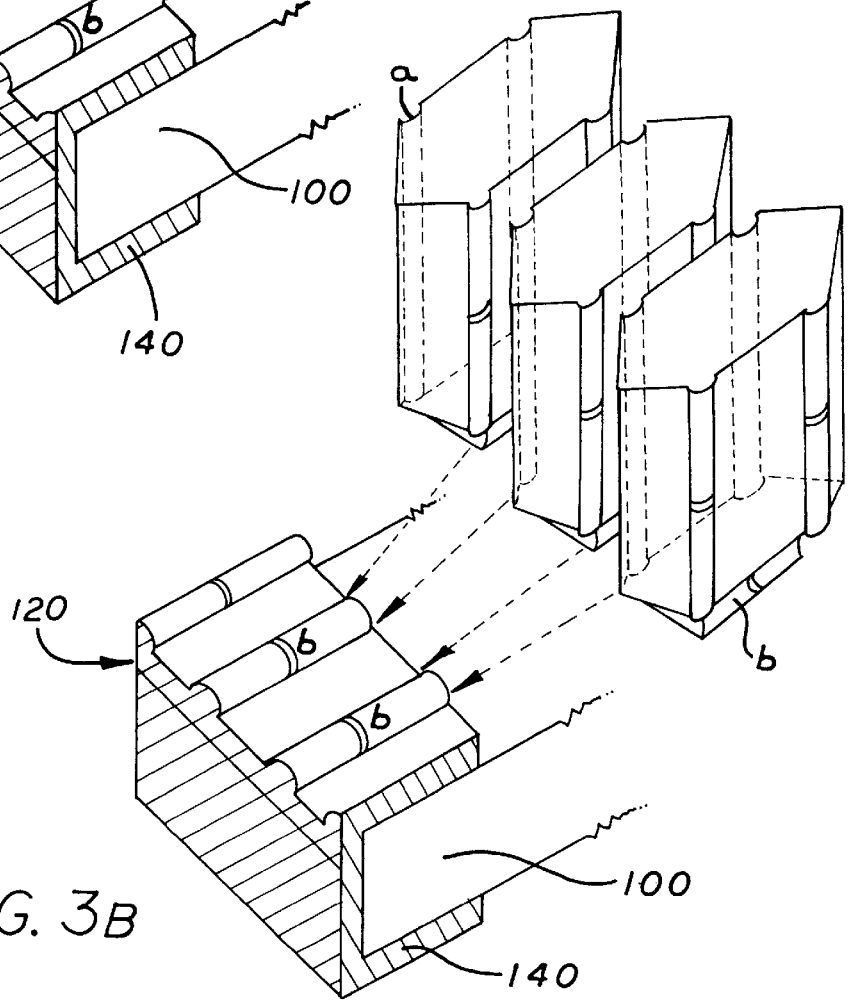
FIG. 3B is a perspective side views of a row of hexagonal surfaces with a hexagonal back surface of a retrofitting system.

A regular twin-size bed 10 has a dimensions of about 75 (length)×39 (width)×8 (height) inches. A regular infant/toddler size bed has a dimension of about 52×28×6 inches. FIGS. 1, 2A and 2B show a retrofitting systems for one, two and three sides of an adult-size bed respectively. From FIGS. 1 and 2A and 2B, a retrofitting system 110 comprises a template 120 being first placed on a twin-size or larger size (full, queen, king-size etc) mattress 100. This template will provide anchoring and stability to the interconnecting geometrical structures. In FIGS. 1, 2A and 2B, the geometrical shape structures are in the form of a rectangular face structure 130. For an adult-size bed one side retrofitting system, part of the template 120 is shown in details in FIG. 3. For a twin-size bed, the dimension of the template is about 26×39×9 inches. The template 120 can be a one-piece construction or it can be constructed of two or more-pieces using methods common to one skill in the art, such as the plate/channel method discussed earlier for connection. An underside 140 of the template is tucked under the mattress, thus preventing the geometrical structure from rolling over when a baby or someone is pulling or leaning onto the structure. 130. The upper-side of the template 120 contains plates/channels which are to be connected to the channels/plates of the interconnecting geometrical structures 130 (see FIG. 3). One side S1 of the interconnecting geometrical shape structure has a plate to which it is connected to a channel on one side S2 of another geometrical structure. To provide additional stability and anchoring strength, an anchoring concave/convex surfaces are used in the channel/plate connecting system.(see FIG. 4). This prevent the plate from accidentally sliding out from the channel once it is in place. The rectangular geometrical shape structure can be used for storage spaces for diapers, lotion, wash cloths, clothing, toys and other accessories for the baby.

Alternatively, as shown in FIGS. 5 and 6, one of the rectangular shape structure can be converted into a chair and another into a table. To form a chair, the geometrical shape structure has its top removed and placed in the center channel providing a sitting place as a chair. To form a table, a side panel of the geometrical shape structure can be removed and connect to its top forming a table. The geometrical shape structure is constructed of a safe, non-toxic, easy to fabricate material, such as but not limited to thermoplastics, specialty plastics, thermosets, engineering plastics etc.

Thermoplastics include but not limited to: polyamideimide (PAI), polyethersulfone (PES), polyarylsulfone (PAS), polyetherimide (PEI), polyarylate (PAR), polysulfone (PSO), polyamide (PA), polycarbonate (PC), styrene-maleic anhydride (SMA), chorinated PVC (CPVC), poly (methylmethacrylate) (PMMA), styrene-acrylonitrile (SAN), polystyrene (PS), acrylonitrile-butadiene-styrene (PS), acrylonitrilebutadiene-styrene (ABS), poly (ethyleneterephthalate) (PET), poly(vinylchloride) (PVC), polyetherketone (PEK), polyetheretherketone (PEEK), polytetrafluoroethylene (PTFE), poly(phenylene sulfide) (PPS), liquid crystal polymer (CCP), nylon-6,6, nylon-6, nylon-6,12, nylon-11, nylon 12, acetal resin, polypropylene (PP), high density polyethylene (HDPE), low density polyethylene (LDPE), polystyrene, ethylene-vinyl acetate, polyvinyl-acetate, polyacrylic, etc., or a copolymer or a combination thereof.

Specialty plastics include but not limited to fluorocarbon polymers, infusible film products such as Kapton and Upilex polyimide film, etc., a copolymer or a combination thereof. Thermosets include but not limited to phenolics, epoxies, urea-formaldehyde and silicones, etc., a copolymer or a combination thereof. Engineering plastics include but not limited to acetyl resins, polyamide, polyetherimides, polyesters, liquid crystal polymers, polycarbonate resins, poly(phenylene ether) alloys, polysulfone resins, polyamideimide resins, etc., a copolymer or a combination thereof.

The geometrical shape structures of the retrofitting system can be converted into a snake with accessories, such as a head 220 and tail 230 pieces (FIG. 7). Also, the top portion of the geometrical structures can be converted into a changing table by accessories such as an infant changer 240 having sloping sides that cushion baby, with plates/channels on the underside of the changer connecting to the top portion of the geometrical structures (see FIG. 1).

What is claimed is:

1. An adult size bed retrofitting system comprises a template placed on an adult size bed and a number of interconnecting geometrical shape structures, on at least one-side of the bed, connecting to the template, said template has an extension connected to an underside of a mattress to provide stability in preventing the system from toppling over, said geometrical shape interconnecting structure connected to said template by a plate/channel system, said geometrical shape interconnecting structure further comprises more than one individual structure on each side of the bed and provide storage spaces for a caretaker's use items for a baby.

2. An adult size bed retrofitting system of claim 1 with said connecting geometrical shape structures further comprises a row of rectangular surface with a rectangular back surface.

3. An adult size bed retrofitting system of claim 1 with the template further fabricated from a thermoplastic materials.

4. An adult size bed retrofitting system of claim 1 with the thermoplastic material further comprises polyamideimide (PAI), polyethersulfone (PES), polyarylsulfone (PAS), polyetherimide (PEI), polyarylate (PAR), polysulfone (PSO), polyamide (PA), polycarbonate (PC), styrene-maleic anhydride (SMA), chorinated PVC (CPVC), poly (methylmethacrylate) (PMMA), styrene-acrylonitrile (SAN), polystyrene (PS), acrylonitrile-butadiene-styrene (PS), acrylonitrile-butadiene-styrene (ABS), poly (ethyleneterephthalate) (PET), poly(vinylchloride) (PVC), polyetherketone (PEK), polyetheretherketone (PEEK), polytetrafluoroethylene (PTFE), poly(phenylene sulfide) (PPS), liquid crystal polymer (CCP), nylon-6,6, nylon-6, nylon-6,12, nylon-11, nylon 12, acetal resin, polypropylene (PP), high density polyethylene (HDPE), low density polyethylene (LDPE), polystyrene, ethylene-vinyl acetate, polyvinyl-acetate, polyacrylic, a copolymer and a combination thereof.

5. An adult size bed retrofitting system of claim 1 with the template further fabricated from a specialty plastics material.

6. An adult size bed retrofitting system of claim 5 with the specialty plastics materials further comprises fluorocarbon polymers, infusible film products, a copolymer and a combination thereof.

7. An adult bed retrofitting system of claim 1 with the template further fabricated from a thermosets materials.

8. An adult size bed retrofitting system of claim 7 with the thermosets materials further comprises phenolics, epoxies, urea-formaldehyde, silicones, a copolymer and a combination thereof.

9. An adult bed retrofitting system of claim 1 with the template further fabricated from an engineering plastics materials.

10. An adult size bed retrofitting system of claim 9 with the engineering plastics materials further comprises acetyl resins, polyamide, polyetherimides, polyesters, liquid crystal polymers, polycarbonate resins, poly(phenylene ether) alloys, polysulfone resins, polyamideimide resins, a copolymer and a combination thereof.

11. An adult size bed retrofitting system of claim 1 with the connecting geometrical shape structures further comprises a row of triangular surfaces with a rectangular surface.

12. An adult size bed retrofitting system of claim 1 with said connecting geometrical shape structures further comprises a row of hexagonal surfaces with a hexagonal back surface.

* * * * *